US012745801B2

(12) United States Patent
Ouyang et al.

(10) Patent No.: US 12,745,801 B2
(45) Date of Patent: Sep. 29, 2026

(54) VAPORIZER AND ELECTRONIC VAPORIZATION DEVICE WITH PREHEATING MEMBER

(71) Applicant: SHENZHEN SMOORE TECHNOLOGY LIMITED, Shenzhen (CN)

(72) Inventors: Wenting Ouyang, Shenzhen (CN); Guoliang Ou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 602 days.

(21) Appl. No.: 18/189,895

(22) Filed: Mar. 24, 2023

(65) Prior Publication Data

US 2023/0320425 A1 Oct. 12, 2023

(30) Foreign Application Priority Data

Apr. 6, 2022 (CN) ..... 202210360013.4

(51) Int. Cl.

| | |
|---|---|
| ***A24F 40/46*** | (2020.01) |
| ***A24F 40/10*** | (2020.01) |
| ***A24F 40/42*** | (2020.01) |
| ***A24F 40/485*** | (2020.01) |
| ***A24F 40/50*** | (2020.01) |
| *A24F 40/44* | (2020.01) |

(52) U.S. Cl.

CPC ..... *A24F 40/46* (2020.01); *A24F 40/10* (2020.01); *A24F 40/42* (2020.01); *A24F 40/485* (2020.01); *A24F 40/50* (2020.01); *A24F 40/44* (2020.01)

(58) Field of Classification Search

CPC ..... A24F 40/46; A24F 40/48; A24F 40/485; A24F 40/10; A24F 40/42

See application file for complete search history.

(56) References Cited

U.S. PATENT DOCUMENTS

2013/0160765 A1 6/2013 Liu
2020/0107583 A1 4/2020 Wu et al.
(Continued)

FOREIGN PATENT DOCUMENTS

CN 110051051 A 7/2019
CN 110403253 A 11/2019
(Continued)

OTHER PUBLICATIONS

Translation of CN 111227306 A (Year: 2020).*
(Continued)

*Primary Examiner* — Michael H. Wilson
*Assistant Examiner* — Michael Patrick Mullen
(74) *Attorney, Agent, or Firm* — Leydig, Voit & Mayer, Ltd.

(57) ABSTRACT

A vaporizer includes: a liquid storage assembly having a liquid storage cavity and a liquid inlet hole, the liquid storage cavity storing an aerosol-generating substrate; a heating assembly arranged in the liquid storage assembly, the heating assembly being in fluid communication with the liquid storage cavity through the liquid inlet hole; and a preheating member arranged in the liquid storage cavity, the preheating member being located near the liquid inlet hole and preheating the aerosol-generating substrate.

10 Claims, 5 Drawing Sheets

(56) References Cited

U.S. PATENT DOCUMENTS

| | | | | |
|---|---|---|---|---|
| 2020/0120988 | A1* | 4/2020 | Qiu | A24F 40/50 |
| 2022/0007716 | A1* | 1/2022 | Lin | A24F 40/10 |

FOREIGN PATENT DOCUMENTS

| | | | | |
|---|---|---|---|---|
| CN | 110447966 | A | 11/2019 | |
| CN | 209825216 | U | 12/2019 | |
| CN | 111227306 | A | 6/2020 | |
| CN | 111345507 | A | 6/2020 | |
| CN | 210901382 | U | 7/2020 | |
| CN | 210901387 | U | 7/2020 | |
| CN | 214903812 | U | 11/2021 | |
| CN | 113812686 | A | 12/2021 | |
| CN | 113892690 | A | 1/2022 | |
| CN | 215775569 | U | 2/2022 | |
| CN | 216019121 | U | 3/2022 | |
| CN | 218303439 | U | 1/2023 | |
| WO | WO-2018201858 | A1 * | 11/2018 | A24F 40/46 |
| WO | 2019200194 | A1 | 10/2019 | |

OTHER PUBLICATIONS

Translation of CN 113812686 A (Year: 2021).*
Translation of CN 215775569 U (Year: 2022).*
Translation of CN 214903812 U (Year: 2021).*
Translation of CN 111345507 A (Year: 2020).*
Translation of WO 2018201858 A1 (Year: 2018).*
Patent Cooperation Treaty, International Search Report and Written Opinion, International Application No. PCT/CN2022/085401 (Nov. 28, 2022).
Chinese Patent Office, Office Action in Chinese Patent Application No. 202210360013.4 (May 30, 2025).

* cited by examiner

VAPORIZER AND ELECTRONIC VAPORIZATION DEVICE WITH PREHEATING MEMBER

CROSS-REFERENCE TO PRIOR APPLICATION

Priority is claimed to Chinese Patent Application No. 202210360013.4, filed on Apr. 6, 2022, the entire disclosure of which is hereby incorporated by reference herein.

FIELD

This application relates to the field of electronic vaporization technologies, and in particular, to a vaporizer and an electronic vaporization device.

BACKGROUND

An electronic vaporization device usually includes a vaporizer and a main unit. The vaporizer is configured to store and vaporize an aerosol-generating substrate, and the main unit is configured to provide energy for the vaporizer and control the vaporizer to vaporize the aerosol-generating substrate.

When the aerosol-generating substrate stored in the vaporizer is viscous, the fluidity of the aerosol-generating substrate is poor at an initial stage of vaporization, and a heating assembly of the vaporizer is easy to suffer dry burning. In addition, the poor fluidity of the aerosol-generating substrate also decreases the vaporization amount.

SUMMARY

In an embodiment, the present invention provides a vaporizer, comprising: a liquid storage assembly having a liquid storage cavity and a liquid inlet hole, the liquid storage cavity being configured to store an aerosol-generating substrate; a heating assembly arranged in the liquid storage assembly, the heating assembly being in fluid communication with the liquid storage cavity through the liquid inlet hole; and a preheating member arranged in the liquid storage cavity, the preheating member being located near the liquid inlet hole and configured to preheat the aerosol-generating substrate.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
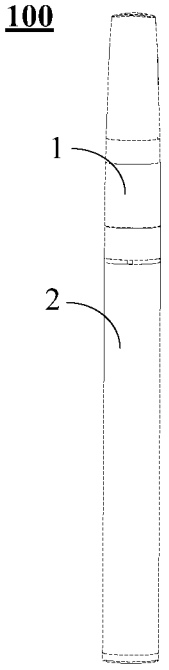
FIG. 1 is a schematic structural diagram of an electronic vaporization device according to an embodiment of this application.

In an embodiment, the present invention provides a vaporizer and an electronic vaporization device, to resolve the technical problem that a heating assembly is easy to suffer dry burning and the vaporization amount is decreased due to the viscous aerosol-generating substrate in the prior art.

In an embodiment, the present invention provides a vaporizer, including a liquid storage assembly, a heating assembly, and a preheating member. The liquid storage assembly has a liquid storage cavity and a liquid inlet hole, where the liquid storage cavity is configured to store an aerosol-generating substrate. The heating assembly is arranged in the liquid storage assembly and is in fluid communication with the liquid storage cavity through the liquid inlet hole. The preheating member is arranged in the liquid storage cavity and located near the liquid inlet hole. The preheating member is configured to preheat the aerosol-generating substrate.

The liquid storage assembly includes a vaporization tube and a vent tube. The vent tube is arranged in the vaporization tube. The liquid storage cavity is formed between the inner surface of the vaporization tube and the outer surface of the vent tube; and the tube wall of the vent tube is provided with the liquid inlet hole. The heating assembly is arranged in the vent tube, and the preheating member is arranged between the vaporization tube and the vent tube.

The vent tube is thermally connected to the heating assembly, and the preheating member is thermally connected to the vent tube.

The preheating member and the vent tube are integrally formed.

The vaporizer further includes a connection base, the heating assembly is electrically connected to a main unit through the connection base, and the connection base is in contact with the vent tube; and the preheating member and the connection base are integrally formed.

The preheating member is fixed on the vent tube, and the preheating member is in contact with the vent tube.

The vent tube includes a first tube section and a second tube section. The liquid inlet hole is arranged in the second tube section; the heating assembly is arranged in the second tube section and is in contact with the second tube section; the preheating member is in contact with the second tube section; and the second tube section and the preheating member are made of metal.

The vaporizer further includes a connection base, the heating assembly and the preheating member are electrically connected to a main unit through the connection base, and the preheating member is configured to generate heat after being powered on.

The preheating member is fixed on the vent tube and/or the connection base; and the vent tube is thermally connected to the heating assembly.

The preheating member is annular and arranged around the vent tube, and the preheating member is spaced apart from the vent tube.

To resolve the technical problems, a second technical solution provided in this application is to provide an electronic vaporization device, including a vaporizer and a main unit. The vaporizer is configured to store and vaporize an aerosol-generating substrate; the vaporizer is the foregoing vaporizer; and the main unit is configured to provide energy for the vaporizer and control operation of the vaporizer.

Different from the prior art, this application provides a vaporizer and an electronic vaporization device, where the vaporizer includes a liquid storage assembly, a heating assembly, and a preheating member. The liquid storage assembly has a liquid storage cavity and a liquid inlet hole, where the liquid storage cavity is configured to store an aerosol-generating substrate. The heating assembly is arranged in the liquid storage assembly and is in fluid communication with the liquid storage cavity through the liquid inlet hole. The preheating member is arranged in the liquid storage cavity and located near the liquid inlet hole. The preheating member is configured to preheat the aerosol-generating substrate, to reduce the viscosity of the aerosol-generating substrate near the liquid inlet hole, improve the fluidity of the aerosol-generating substrate, ensure sufficient liquid supply to the heating assembly, and avoid dry burning of the heating assembly.

The technical solutions in the embodiments of this application are clearly and completely described below with reference to the accompanying drawings in the embodiments of this application. Apparently, the described embodiments are merely some rather than all of the embodiments of this application. Based on the embodiments of this application, all other embodiments obtained by a person of ordinary skill in the art without creative efforts shall fall within the protection scope of this application.

In the following description, for the purpose of illustration rather than limitation, specific details such as the specific system structure, interface, and technology are proposed to thoroughly understand this application.

The terms "first", "second", and "third" in this application are merely intended for a purpose of description, and shall not be understood as indicating or implying relative significance or implicitly indicating the number of indicated technical features. Therefore, features defining "first", "second", and "third" can explicitly or implicitly include at least one of the features. In the description of this application, "a plurality of" means at least two, such as two and three unless it is specifically defined otherwise. All directional indications (for example, upper, lower, left, right, front, and back) in the embodiments of this application are only used for explaining relative position relationships, movement situations, or the like among the various components in a specific posture (as shown in the accompanying drawings). If the specific posture changes, the directional indications change accordingly. In the embodiments of this application, the terms "include", "have", and any variant thereof are intended to cover a non-exclusive inclusion. For example, a process, method, system, product, or device that includes a series of steps or units is not limited to the listed steps or units, but further optionally includes a step or unit that is not listed, or further optionally includes another step or component that is intrinsic to the process, method, product, or device.

"Embodiment" mentioned in this specification means that particular features, structures, or characteristics described with reference to the embodiment may be included in at least one embodiment of this application. The term appearing at different positions of this specification may not refer to the same embodiment or an independent or alternative embodiment that is mutually exclusive with another embodiment. A person skilled in the art explicitly or implicitly understands that the embodiments described in this specification may be combined with other embodiments.

This application is further described in detail below with reference to the accompanying drawings and embodiments.

Referring to FIG. 1, FIG. 1 is a schematic structural diagram of an electronic vaporization device according to an embodiment of this application. In this embodiment, an electronic vaporization device 100 is provided. The electronic vaporization device 100 may be configured to vaporize an aerosol-generating substrate. The electronic vaporization device 100 includes a vaporizer 1 and a main unit 2 that are electrically connected to each other.

The vaporizer 1 is configured to store the aerosol-generating substrate and vaporize the aerosol-generating substrate to form aerosols that can be inhaled by a user. The vaporizer 1 may be specifically applied to different fields, for example, medical treatment, cosmetics, and recreation inhalation. In a specific embodiment, the vaporizer 1 may be applied to an electronic aerosol vaporization device to vaporize an aerosol-generating substrate and generate aerosols for inhalation by an inhaler, and the following embodiments are described by using the recreation inhalation as an example. Certainly, in other embodiments, the vaporizer 1 may further be applied to a hair spraying device to vaporize a hair spray for hair styling, or applied to a device for treating upper and lower respiratory diseases to vaporize medical drugs.

For the specific structure and function of the vaporizer 1, reference may be made to the specific structure and function of the vaporizer 1 in any of the following embodiments, and can achieve the same or similar technical effects. Details are not described herein again. The main unit 2 includes a battery and a controller. The battery is configured to supply energy to operation of the vaporizer 1, so that the vaporizer 1 can vaporize the aerosol-generating substrate to form aerosols; and the controller is configured to control operation of the vaporizer 1 to vaporize the aerosol-generating substrate. The main unit 2 further includes other components such as a battery holder and an airflow sensor.

The vaporizer 1 and the main unit 2 may be integrally arranged or may be detachably connected to each other, which may be designed according to a specific requirement.

Figure 2:
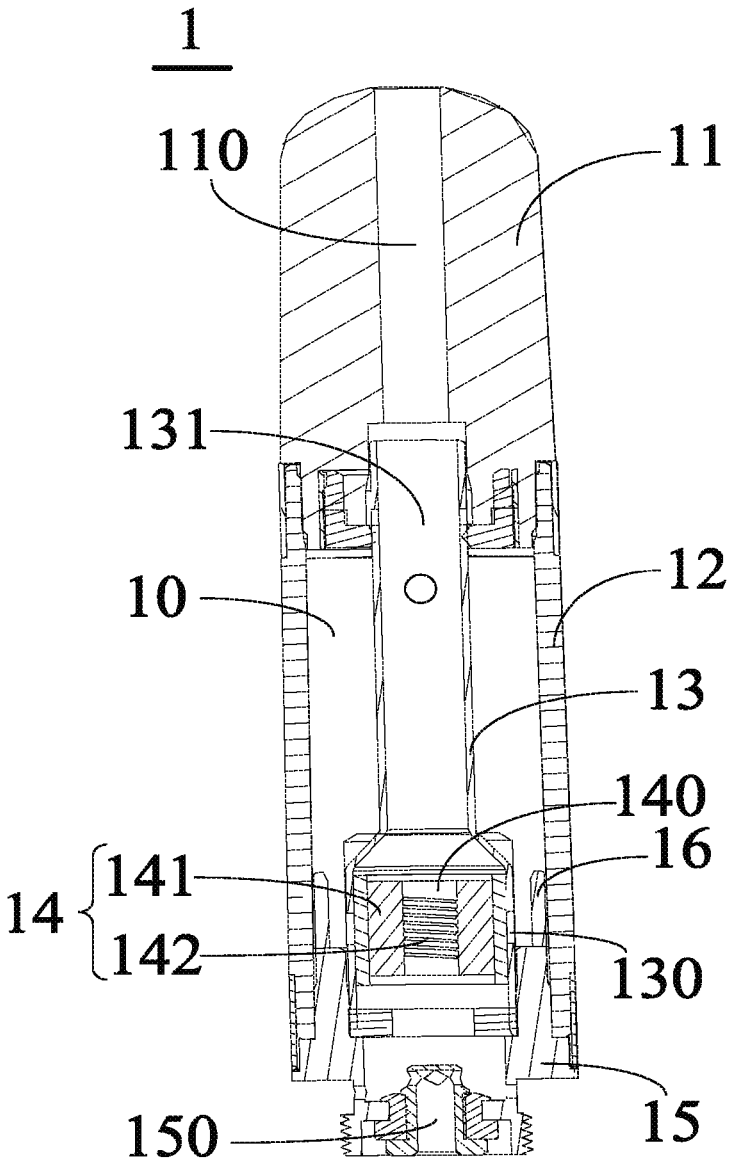
FIG. 2 is a schematic structural diagram of a vaporizer according to an embodiment of this application.

Referring to FIG. 2, FIG. 2 is a schematic structural diagram of a vaporizer according to an embodiment of this application. The vaporizer 1 includes a suction nozzle assembly 11, a vaporization tube 12, a vent tube 13, a heating assembly 14, and a connection base 15. The vaporization tube 12 and the vent tube 13 constitute a liquid storage assembly to form a liquid storage cavity 10. The liquid storage assembly has the liquid storage cavity 10 and a liquid inlet hole 130. Specifically, the vaporization tube 12 includes a first end and a second end opposite to each other. The suction nozzle assembly 11 is arranged at the first end of the vaporization tube 12, and the connection base 15 is arranged at the second end of the vaporization tube 12. The vent tube 13 is arranged in the vaporization tube 12, and the liquid storage cavity 10 is formed between the inner surface of the vaporization tube 12 and the outer surface of the vent tube 13. The suction nozzle assembly 11, the vaporization tube 12, the vent tube 13, and the connection base 15 form an enclosed liquid storage cavity 10 by fitting, and the liquid storage cavity 10 is configured to store an aerosol-generating substrate. The heating assembly 14 is arranged in the liquid storage assembly. Specifically, the heating assembly 14 is arranged in the vent tube 13, the tube wall of the vent tube 13 is provided with the liquid inlet hole 130, and the heating assembly 14 is in fluid communication with the liquid storage cavity 10 through the liquid inlet hole 130, so that the heating assembly 14 vaporizes the aerosol-generating substrate to generate aerosols that can be inhaled by a user.

It may be understood that, enclosed means enclosed except that the liquid storage cavity 10 may supply liquid to the heating assembly 14 through the liquid inlet hole 130.

In this embodiment, the heating assembly 14 includes a porous liquid guide member 141 and a heating body 142.

The porous liquid guide member 141 and the heating body 142 are both annular bodies, and the heating body 142 is attached to the inner surface of the porous liquid guide member 141. The aerosol-generating substrate in the liquid storage cavity 10 flows into the porous liquid guide member 141 through the liquid inlet hole 130. The aerosol-generating substrate is guided to the heating body 142 by the capillary force of the porous liquid guide member 141, and is heated and vaporized by the heating body 142 to generate the aerosols. The space formed around the heating body 142 is defined as a vaporization cavity 140. That is, the heating assembly 14 is an annular body and the inner space of the heating assembly 14 is the vaporization cavity 140. The outer surface of the porous liquid guide member 141 and the inner surface of the vent tube 13 are attached to prevent the aerosol-generating substrate passing through the liquid inlet hole 130 from leaking between the outer surface of the porous liquid guide member 141 and the inner surface of the vent tube 13. The porous liquid guide member 141 may be a porous ceramic or a cotton core, and the heating body 142 may be a heating film, a heating wire, or a heating mesh. The porous liquid guide member 141 is not limited to an annular shape, and may be a sheet-shaped structure.

In other embodiments, the heating assembly 14 may be a porous conductive ceramic, and the porous conductive ceramic has functions of liquid guidance and heating vaporization. The heating assembly 14 is an annular body, and the inner space of the heating assembly 14 is defined as the vaporization cavity 140. The outer surface of the heating assembly 14 and the inner surface of the vent tube 13 are attached to prevent the aerosol-generating substrate passing through the liquid inlet hole 130 from leaking between the outer surface of the porous liquid guide member 141 and the inner surface of the vent tube 13.

The heating assembly 14 further includes a first electrode and a second electrode, and the first electrode and the second electrode are electrically connected to the main unit 2 through the connection base 15. In an implementation, the connection base 15 is provided with a first conductor and a second conductor. The first conductor electrically connects the first electrode of the heating assembly 14 to one electrode of the main unit 2, and the second conductor electrically connects the second electrode of the heating assembly 14 to another electrode of the main unit 2. The first conductor and second conductor may be ejector pins or pogo pins. In another implementation, the connection base 15 includes a first annular conductive member, an annular insulator, and a second annular conductive member. The annular insulator is arranged between the first annular conductive member and the second annular conductive member to insulate the first annular conductive member from the second annular conductive member. The first electrode of the heating assembly 14 is electrically connected to one electrode of the main unit 2 through the first annular conductive member, and the second electrode of the heating assembly 14 is electrically connected to another electrode of the main unit 2 through the second annular conductive member.

The suction nozzle assembly 11 forms a first channel 110. The vent tube 13 forms a second channel 131. The vaporization cavity 140 is in communication with the first channel 110 through the second channel 131. The connection base 15 is provided with a third channel 150, and external air is in communication with the vaporization cavity 140 through the third channel 150. That is, the air flowing direction in the vaporizer 1 is that the external air enters the vaporization cavity 140 through the third channel 150, enters the first channel 110 through the second channel 131 by carrying the aerosol-generating substrate in the vaporization cavity 140, and finally inhaled by the user.

The vaporizer 1 further includes a preheating member 16. The preheating member 16 is arranged between the vaporization tube 12 and the vent tube 13, and the preheating member 16 is located near the liquid inlet hole 130 of the vent tube 13, that is, the preheating member 16 is arranged in the liquid storage cavity 10. The preheating member 16 is configured to preheat the aerosol-generating substrate to reduce the viscosity of the aerosol-generating substrate near the liquid inlet hole 130, so that the fluidity of the aerosol-generating substrate near the liquid inlet hole 130 is better, thereby ensuring sufficient liquid supply to the heating assembly 14 and avoiding dry burning and burnt smell. The preheating member 16 is made of metal.

It may be understood that the vaporizer 1 in this application is not limited to the foregoing structure, and may adopt other structures, as long as the preheating member 16 is arranged near the liquid inlet hole 130 of the liquid storage cavity 10. The preheating member 16 may be configured to conduct heat of the heating assembly 14, or may actively generate heat.

In an implementation, the preheating member 16 is annular and is arranged around the vent tube 13, and the preheating member 16 shields the liquid inlet hole 130 and is spaced apart from the vent tube 13. By setting the preheating member 16 in an annular shape, the heat for preheating the aerosol-generating substrate along the circumference of the vent tube 13 is uniform before the aerosol-generating substrate enters the liquid inlet hole 130. In another implementation, the vaporizer 1 includes a plurality of preheating members 16, the number of the preheating members 16 is the same as that of the liquid inlet holes 130, and one preheating member 16 is arranged near one liquid inlet hole 130. The preheating member 16 covers at least a part of one liquid inlet hole 130 on a projection of the vent tube 13, and can preheat the aerosol-generating substrate that is about to enter the liquid inlet hole 130.

Figure 3:
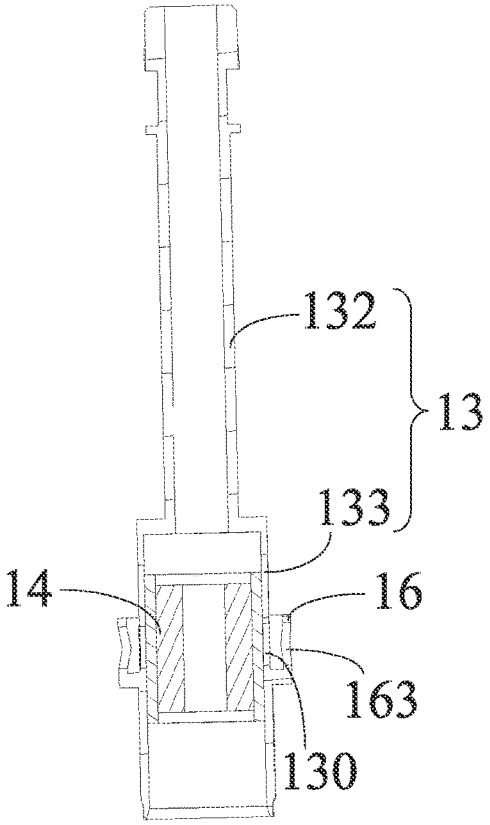
FIG. 3 is a schematic diagram of an assembly structure of a vent tube and a heating assembly in the vaporizer in FIG. 2.

In an implementation, the vent tube 13 is thermally connected to the heating assembly 14, and the preheating member 16 is thermally connected to the vent tube 13. The vent tube 13 and the preheating member 16 are made of metal and have good thermal conductivity. Heat generated by heating of the heating assembly 14 is conducted to the vent tube 13, and heat on the vent tube 13 is conducted to the preheating member 16. The preheating member 16 is spaced apart from the vent tube 13, so that the preheating member 16 and the vent tube 13 preheat the aerosol-generating substrate near the liquid inlet hole 130 from both sides, and heat for preheating the part of the aerosol-generating substrate is more uniform, to further ensure sufficient liquid supply to the heating assembly 14. The preheating member 16 may be attached to the vaporization tube 12, or may be spaced apart from the vaporization tube 12. When the preheating member 16 is spaced apart from the vaporization tube 12, the preheating member 16 is provided with a liquid pass hole 163. The aerosol-generating substrate located between the preheating member 16 and the vaporization tube 12 can flow to the position between the preheating member 16 and the vent tube 13 through the liquid pass hole 163, and reach the heating assembly 14 through the liquid inlet hole 130 (as shown in FIG. 3). Optionally, the liquid pass hole 163 on the preheating member 16 is coaxially aligned with the liquid inlet hole 130 in the vent tube 13.

Optionally, the preheating member 16 and the vent tube 13 are integrally formed (referring to FIG. 3, FIG. 3 is a schematic diagram of an assembly structure of a vent tube and a heating assembly in the vaporizer in FIG. 2). As shown in FIG. 3, the preheating member 16 and the vent tube 13 are arranged in parallel, and the preheating member 16 is spaced apart from the vent tube 13. When the preheating member 16 is annular, the preheating member 16 is sleeved outside the vent tube 13.

Since the preheating member 16 and the vent tube 13 are integrally formed, the liquid pass hole 163 is formed at the position corresponding to the preheating member 16 when the vent tube 13 is punched to form the liquid inlet hole 130. The integrally forming of the preheating member 16 and the vent tube 13 facilitates processing and assembly.

Figure 4:
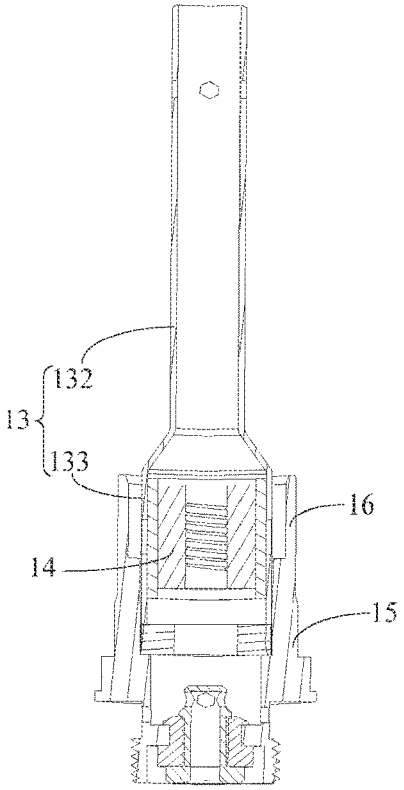
FIG. 4 is a schematic diagram of an assembly structure of a vent tube, a heating assembly, and a connection base in the vaporizer in FIG. 2.

Optionally, the preheating member 16 and the connection base 15 may be integrally formed (referring to FIG. 4, FIG. 4 is a schematic diagram of an assembly structure of a vent tube, a heating assembly, and a connection base in the vaporizer in FIG. 2). The preheating member 16 and the vent tube 13 are arranged in parallel, and the preheating member 16 is spaced apart from the vent tube 13. An end portion of the vent tube 13 is in contact with the connection base 15, and the vent tube 13 conducts heat to the connection base 15, so that the preheating member 16 has a certain amount of heat for preheating. As shown in FIG. 4, the preheating member 16 is annular, and the preheating member 16 is sleeved outside the vent tube 13. The integrally forming of the preheating member 16 and the connection base 15 facilitates processing and assembly.

Figure 5:
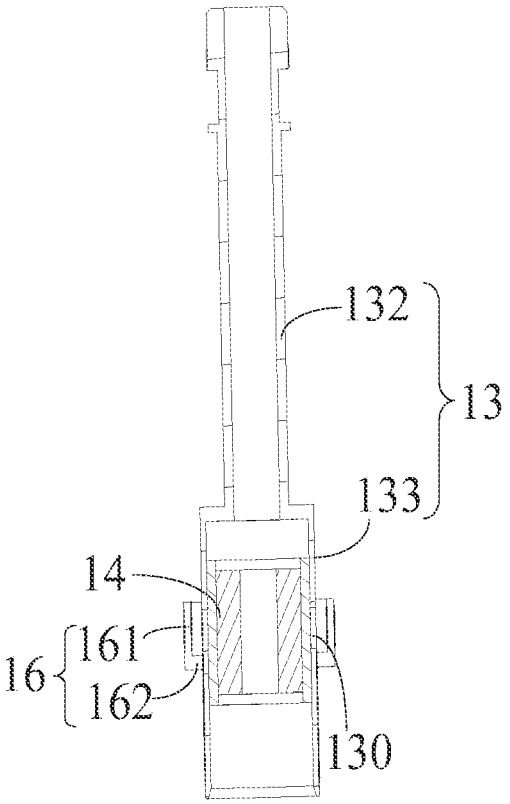
FIG. 5 is a schematic diagram of an assembly schematic of a preheating member, a heating assembly, and a vent tube in the vaporizer in FIG. 2.

Optionally, the preheating member 16 may be a separate element fixed to the vent tube 13, and the preheating member 16 is in direct contact with the vent tube 13 (referring to FIG. 5, FIG. 5 is a schematic diagram of an assembly schematic of a preheating member, a heating assembly, and a vent tube in the vaporizer in FIG. 2). Specifically, the preheating member 16 includes a first portion 161 and a second portion connected to each other. The first portion 161 and the vent tube 13 are arranged in parallel, and the second portion 162 is perpendicular to the vent tube 13. As shown in FIG. 5, the first portion 161 is an annular sidewall and the second portion 162 is a bottom wall connected to the annular sidewall and having a through hole. The first portion 161 of the preheating member 16 is sleeved outside the vent tube 13, that is, the first portion 161 of the preheating member 16 is spaced apart from the vent tube 13. The second portion 162 of the preheating member 16 is sleeved outside the vent tube 13 and is perpendicular to the vent tube 13, and the through hole on the sidewall of the second portion 162 of the preheating member 16 is in contact with the vent tube 13. It may be understood that, the extending direction of the first portion 161 of the preheating member 16 may also be at an angle of less than 45 degrees with the extending direction of the vent tube 13.

Optionally, the preheating member 16 may be a separate element fixed to the connection base 15 and the vent tube 13 is in contact with the connection base 15. The preheating member 16 and the vent tube 13 are arranged in parallel, and the preheating member 16 is spaced apart from the vent tube 13. When the preheating member 16 is annular, the preheating member 16 is sleeved outside the vent tube 13. The end portion of the vent tube 13 is in contact with the connection base 15, the vent tube 13 conducts heat to the connection base 15, and the connection base 15 conducts heat to the preheating member 16, so that the preheating member 16 has a certain amount of heat for preheating.

In another implementation, the preheating member 16 may actively generate heat. Specifically, the preheating member 16 is electrically connected to the main unit 2 through the connection base 15, and self-heating can be implemented through energy supply of the battery of the main unit 2. That is, the preheating member 16 is configured to generate heat after being powered on. For example, the connection base 15 may include two conductive elements that are sleeved with each other and insulated from each other, and the two conductive elements connect a positive electrode and a negative electrode of the preheating member 16 to the main unit 2. For a manner of electrically connecting the preheating member 16 to the main unit 2 through the connection base 15, reference may be made to the manner of electrically connecting the heating assembly 14 to the main unit 2 through the connection base 15, and details are not described herein again. The preheating member 16 and the vent tube 13 are arranged in parallel, and the preheating member 16 is fixed on the vent tube 13 and/or the connection base 15. The vent tube 13 is thermally connected to the heating assembly 14, and the preheating member 16 is spaced apart from the vent tube 13, so that the preheating member 16 and the vent tube 13 preheat the aerosol-generating substrate near the liquid inlet hole 130 from both sides, and the heat for preheating the part of the aerosol-generating substrate is more uniform. The preheating member 16 may be attached to the vaporization tube 12, or may be spaced apart from the vaporization tube 12. When the preheating member 16 is spaced apart from the vaporization tube 12, the preheating member 16 is provided with a liquid pass hole, and the aerosol-generating substrate located between the preheating member 16 and the vaporization tube 12 can flow to the position between the preheating member 16 and the vent tube 13 through the liquid pass hole.

Still referring to FIG. 5, the vent tube 13 includes a first tube section 132 and a second tube section 133. The liquid inlet hole 130 is arranged in the second tube section 133. The heating assembly 14 is arranged in the second tube section 133 and is in contact with the second tube section 133. The preheating member 16 is thermally connected to the second tube section 133, that is, the preheating member 16 is in contact with the second tube section 133. Optionally, the second tube section 133 of the vent tube 13 is made of metal, and the material of the first tube section 132 is designed as required. The first tube section 132 forms a second channel 131. As shown in FIG. 5, the diameter of the second tube section 133 is larger than that of the first tube section 132. By this design, while the vent tube 13 can accommodate the heating assembly 14, the liquid storage capacity of the liquid storage cavity 10 is increased. It may be understood that, in this embodiment, the vent tubes 13 are all in the foregoing structure, and the structure shown in FIG. 5 is described as an example only.

Still referring to FIG. 2, the connection base 15 is configured to form a necking with an end portion connected to the main unit 2, and the outer surface of the connection base 15 is provided with threads. The vaporizer 1 is detachably connected to the main unit 2 through the threads on the connection base 15. By setting the end portion of the connection base 15 as the necking, after the vaporizer 1 is connected to the main unit 2, the outer surface of the vaporizer 1 is flush with the outer surface of the main unit 2. An end surface of the vaporization tube 12 abuts against the connection base 15.

Figure 6:
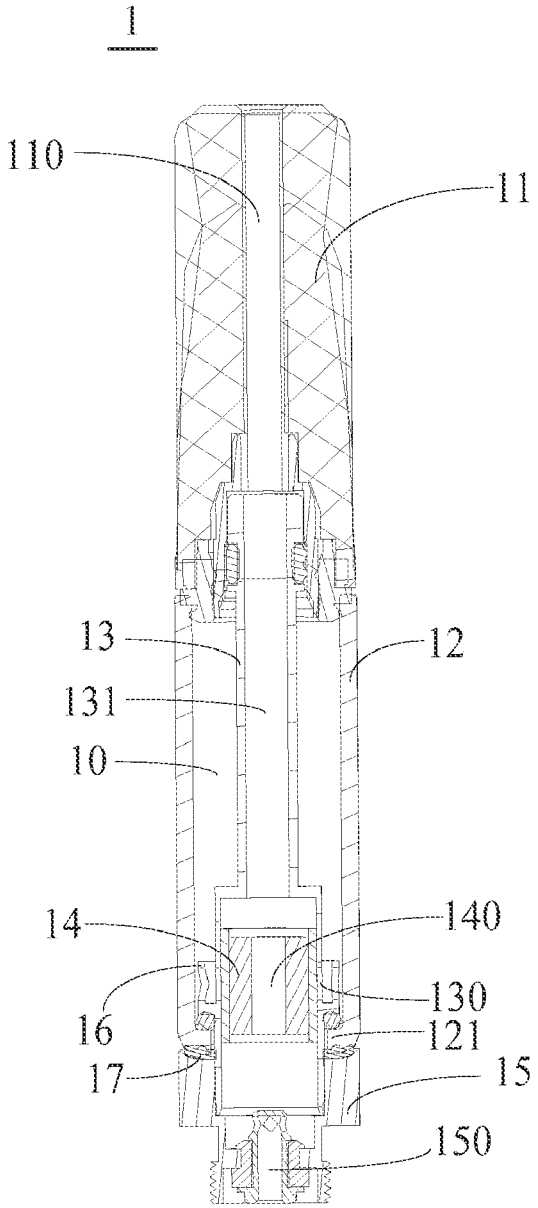
FIG. 6 is a schematic structural diagram of a vaporizer according to another embodiment of this application.

Referring to FIG. 6, FIG. 6 is a schematic structural diagram of a vaporizer according to another embodiment of this application.

The structure of the vaporizer provided in FIG. 6 is basically the same as the structure of the vaporizer provided in FIG. 2, and the difference is the connection manner of the vaporization tube 12 and the connection base 15.

The vaporizer 1 includes a suction nozzle assembly 11, a vaporization tube 12, a vent tube 13, a heating assembly 14, a connection base 15, and a preheating member 16. The vaporization tube 12 includes a first end and a second end opposite to each other. The suction nozzle assembly 11 is arranged at the first end of the vaporization tube 12, and the connection base 15 is arranged at the second end of the vaporization tube 12. The vent tube 13 is arranged in the vaporization tube 12, and a liquid storage cavity 10 is formed between the inner surface of the vaporization tube 12 and the outer surface of the vent tube 13. Specifically, the suction nozzle assembly 11, the vaporization tube 12, the vent tube 13, and the connection base 15 form an enclosed liquid storage cavity 10 by fitting, and the liquid storage cavity 10 is configured to store an aerosol-generating substrate. The heating assembly 14 is arranged in the vent tube 13, and the vent tube 13 is provided with a liquid inlet hole 130. The heating assembly 14 is in fluid communication with the liquid storage cavity 10 through the liquid inlet hole 130, so that the heating assembly 14 vaporizes the aerosol-generating substrate to generate aerosols that can be inhaled by a user. It may be understood that, enclosed means enclosed except that the liquid storage cavity 10 may supply liquid to the heating assembly 14 through the liquid inlet hole 130.

The preheating member 16 is arranged between the vaporization tube 12 and the vent tube 13, and the preheating member 16 is located near the liquid inlet hole 130 of the vent tube 13, that is, the preheating member 16 is arranged in the liquid storage cavity 10. The preheating member 16 is configured to preheat the aerosol-generating substrate to reduce the viscosity of the aerosol-generating substrate near the liquid inlet hole 130, so that the fluidity of the aerosol-generating substrate near the liquid inlet hole 130 is better, thereby ensuring sufficient liquid supply to the heating assembly 14 and avoiding dry burning and burnt smell.

The arrangement of the preheating member 16, and the positional relationship and connection manner between the preheating member 16, the vaporization tube 12, and the vent tube 13 are described above and details are not described herein again.

In this embodiment, an end portion of the vaporization tube 12 near the connection base 15 is bent inward to form a bending portion 121, and the bending portion is configured to contact the connection base 15. Optionally, a seal member 17 is provided between the bending portion 121 of the vaporization tube 12 and the connection base 15.

In another embodiment, the connection base 15 may be in direct contact with the vent tube 13, and the preheating member 16 is in contact connection with the bending portion 121. For example, the preheating member 16 and the bending portion 121 are integrally formed.

In another embodiment, the bending portion 121 may be in direct contact with the vent tube 13, and the preheating member 16 is in contact connection with the bending portion 121. For example, the preheating member 16 and the vaporization tube 12 are integrally formed. The descriptions are merely implementations of this application, and the patent scope of this application is not limited thereto. All equivalent structure or process changes made according to the content of this specification and accompanying drawings in this application or by directly or indirectly applying this application in other related technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a liquid storage assembly having a liquid storage cavity and a liquid inlet hole, the liquid storage cavity being configured to store an aerosol-generating substrate;

a heating assembly arranged in the liquid storage assembly, the heating assembly being in fluid communication with the liquid storage cavity through the liquid inlet hole; and a preheating member arranged in the liquid storage cavity, the preheating member configured to preheat the aerosol-generating substrate, wherein the liquid storage assembly comprises a vaporization tube and a vent tube arranged in the vaporization tube, wherein the liquid storage cavity is formed between an inner surface of the vaporization tube and an outer surface of the vent tube, wherein a tube wall of the vent tube is provided with the liquid inlet hole, wherein the heating assembly is arranged in the vent tube, wherein the preheating member is arranged between the vaporization tube and the vent tube, wherein the preheating member is annular and arranged around the vent tube, wherein the preheating member is spaced apart from the vent tube, wherein the vent tube is thermally connected to the heating assembly, and wherein the preheating member is thermally connected to the vent tube.

2. The vaporizer of claim 1, wherein the preheating member and the vent tube are integrally formed.

3. The vaporizer of claim 1, further comprising:

a connection base, wherein the heating assembly is electrically connected to a main unit through the connection base, wherein the connection base is in contact with the vent tube, and wherein the preheating member and the connection base are integrally formed.

4. The vaporizer of claim 1, wherein the preheating member is fixed on the vent tube, and wherein the preheating member is in contact with the vent tube.

5. The vaporizer of claim 1, wherein the vent tube comprises a first tube section and a second tube section, wherein the liquid inlet hole is arranged in the second tube section, wherein the heating assembly is arranged in the second tube section and is in contact with the second tube section, wherein the preheating member is in contact with the second tube section, and wherein the second tube section and the preheating member comprise metal.

6. The vaporizer of claim 1, further comprising:

a connection base, wherein the heating assembly and the preheating member are electrically connected to a main unit through the connection base, and wherein the preheating member is configured to generate heat after being powered on.

7. The vaporizer of claim 6, wherein the preheating member is fixed on the vent tube and/or the connection base, and wherein the vent tube is thermally connected to the heating assembly.

8. An electronic vaporization device, comprising:

the vaporizer of claim 1 configured to store and vaporize an aerosol-generating substrate; and a main unit configured to provide energy for the vaporizer and control operation of the vaporizer.

9. The vaporizer of claim 1, wherein the preheating member is provided with a liquid pass hole, and wherein the liquid pass hole is coaxially aligned with the liquid inlet hole.

10. The vaporizer of claim 1, wherein the preheating member is provided with a liquid pass hole, and wherein the liquid pass hole is in fluidic communication with the liquid inlet hole.

* * * * *